US006223380B1

(12) United States Patent
Klima et al.

(10) Patent No.: US 6,223,380 B1
(45) Date of Patent: May 1, 2001

(54) SURFACE CONTACTING WITH SPRAY BOTTLE DISPENSERS

(75) Inventors: William L. Klima, Stafford, VA (US); Benjamin A. Pezzlo, Washington, DC (US); Walter F. Klima, Jr., Travelers Rest, SC (US)

(73) Assignee: Sunex L.L.C., Stafford, VA (US)

( * ) Notice: Subject to any disclaimer, the term of this patent is extended or adjusted under 35 U.S.C. 154(b) by 0 days.

(21) Appl. No.: 09/299,734

(22) Filed: Apr. 27, 1999

(51) Int. Cl.[7] ..... A46B 11/02; A47L 1/08

(52) U.S. Cl. ..... 15/118; 15/121; 401/139; 401/188 R; 401/203

(58) Field of Search ..... 134/6, 26; 401/139, 401/137, 263, 187, 188 R, 201, 203; 15/118, 121

(56) References Cited

U.S. PATENT DOCUMENTS

D. 316,318 * 4/1991 Cheang ..... D32/42
D. 386,852 * 11/1997 Viner ..... D32/40
1,093,114 * 4/1914 Corbett ..... 401/139
2,104,161 * 1/1938 Koukal ..... 410/139
3,732,591 * 5/1973 Gach ..... 401/139
4,273,459 * 6/1981 Hardy ..... 410/139
5,316,401 * 5/1994 Sears ..... 401/139

* cited by examiner

*Primary Examiner*—Randy Gulakowski
*Assistant Examiner*—Saeed Chaudhry
(74) *Attorney, Agent, or Firm*—Law Offices of William L. Klima, P.L.C.

(57) ABSTRACT

A dispensing apparatus including a spray bottle dispenser including a bottle portion and a spray head portion and a frame portion connecting said dispenser to a surface contacting portion and configured such that when said dispensing apparatus is in an upright position, said surface contacting portion is located above and in front of a nozzle portion of said spray head portion.

25 Claims, 16 Drawing Sheets

FIG. 9
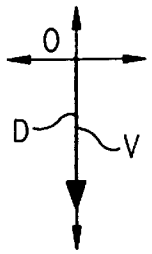
FIG. 10
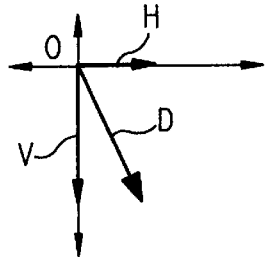
FIG. 11
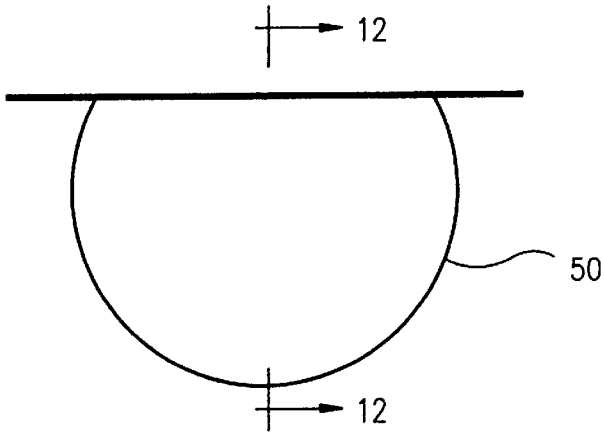
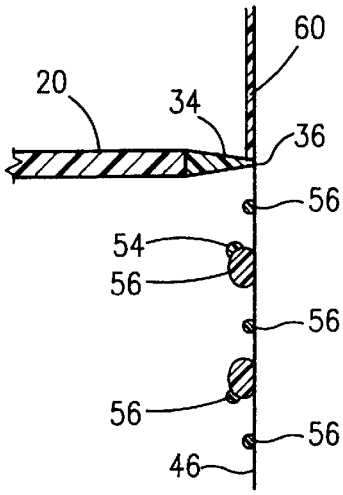
FIG. 12
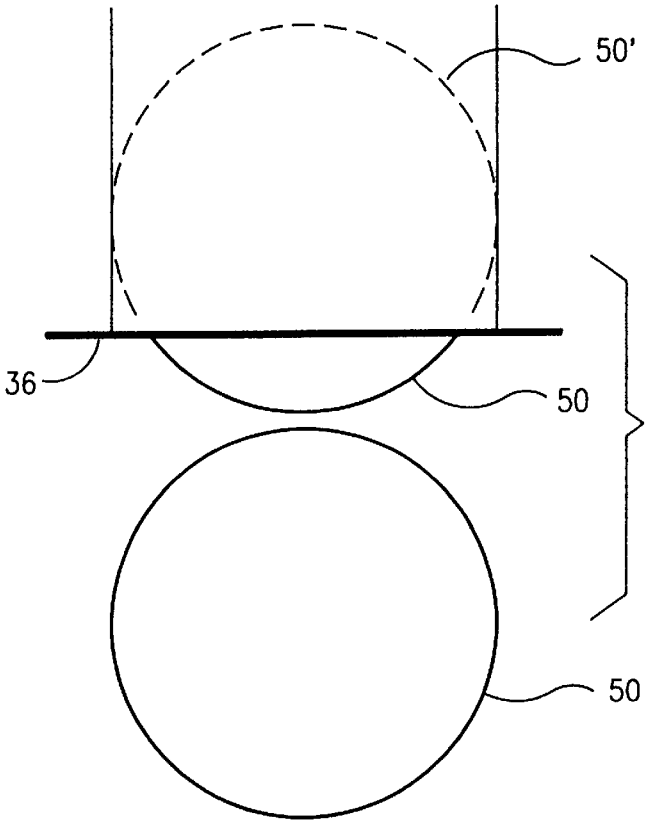
FIG. 13

FIG. 14
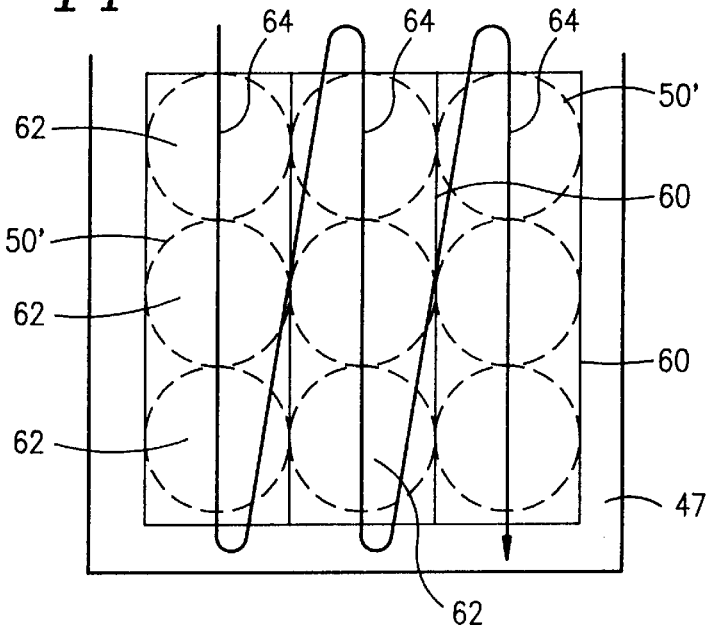
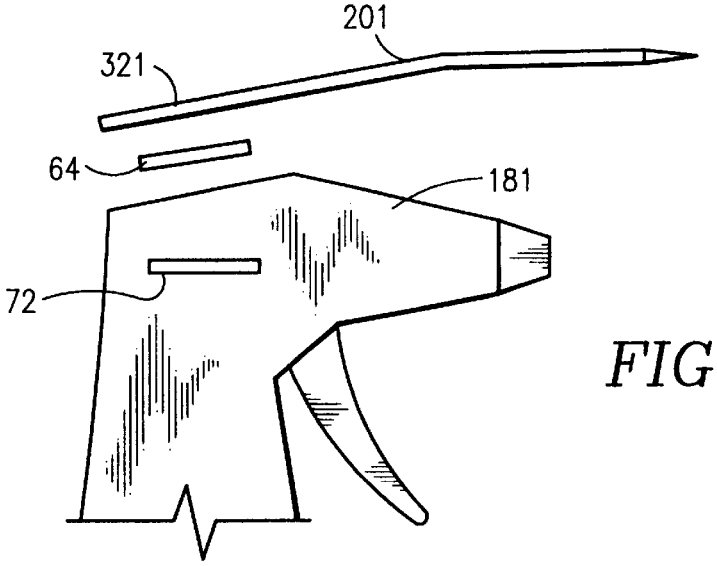
FIG. 15
FIG. 16
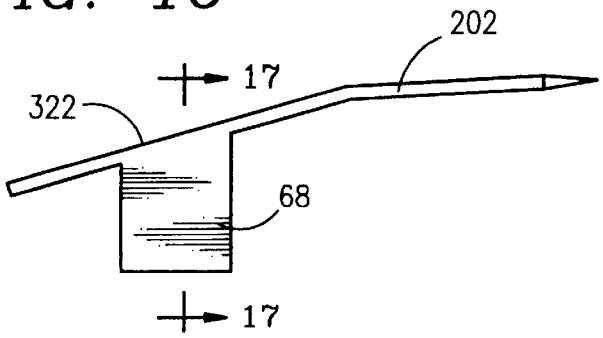
FIG. 17
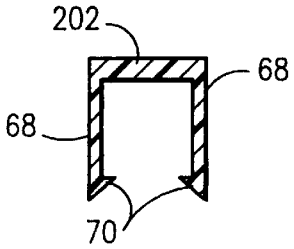

FIG. 22
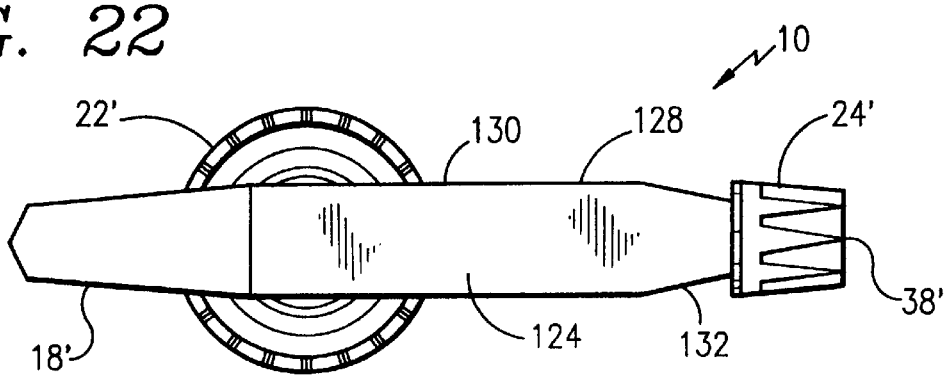
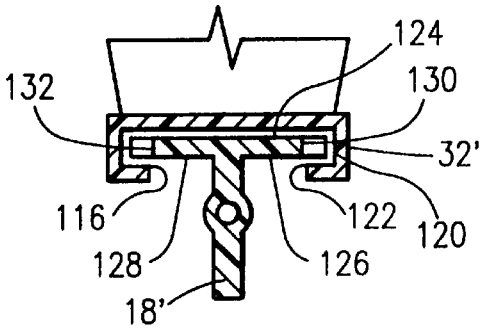
FIG. 23
FIG. 24
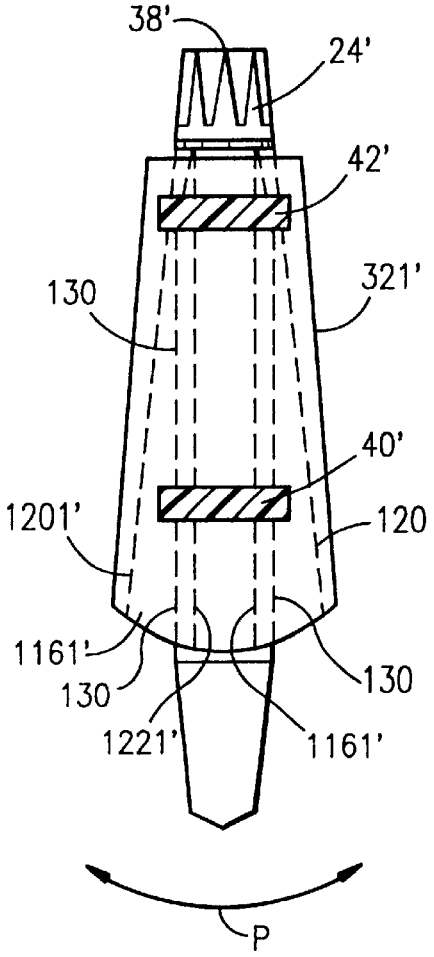
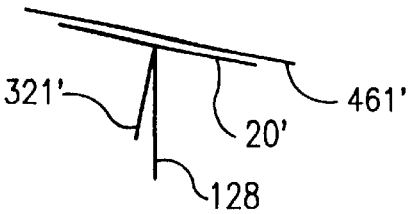
FIG. 25

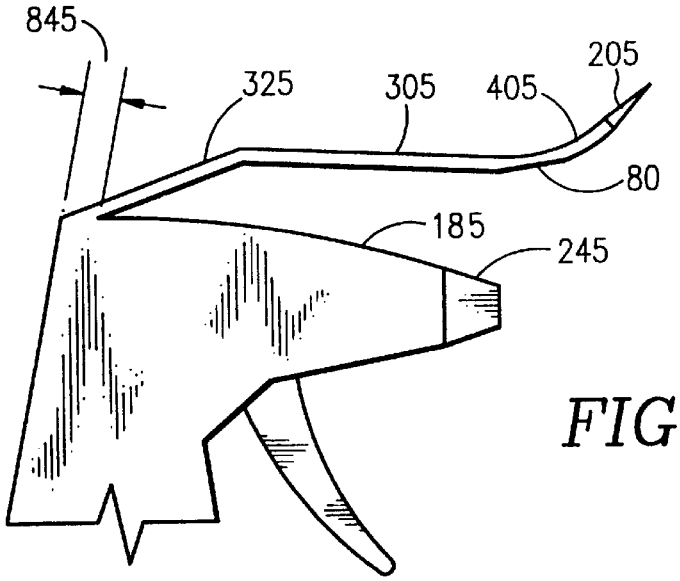
FIG. 29
FIG. 30
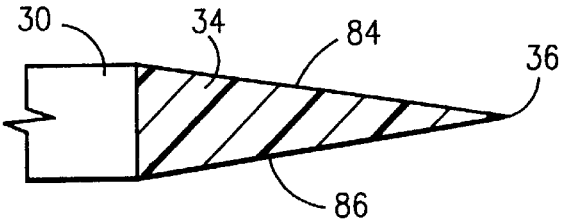
FIG. 31
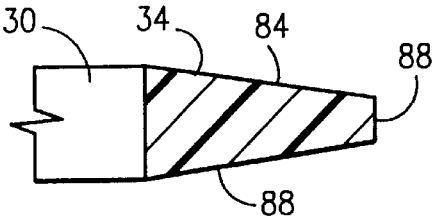
FIG. 32
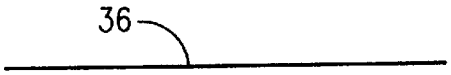
FIG. 33
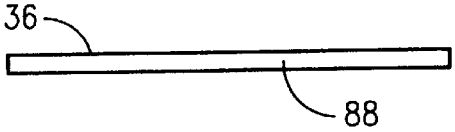
FIG. 34
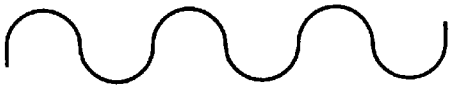
FIG. 35
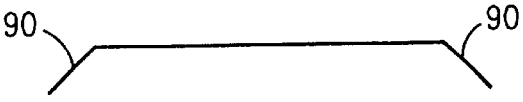

SURFACE CONTACTING WITH SPRAY BOTTLE DISPENSERS

FIELD OF THE INVENTION

The present invention is directed to dispensers, and particularly, to surface contacting with spray bottle dispensers.

BACKGROUND OF THE INVENTION

There are a myriad of products dispensed from spray bottles. An example of a product provided in a spray bottle dispenser is a preventive maintenance type cleaner applied onto surfaces proximal to a personal wash area, typically, a shower or bath, immediately or relatively soon after the wash area is used. This type of product is presently being marketed by a number of different companies. For example, one company is selling such a product under the trademark, CLEAN SHOWER. This product is marketed on the premise that by applying it to the surfaces of a wash area after each use, build up of wash area related dirt, such as soap scum, is minimized.

Another example of a product dispensed from a spray bottle is glass cleaner. In a typical window cleaning operation, a spray bottle dispenser containing window cleaner is operated proximally to a window to apply cleaner to the window pane. In a second step, a squeegee is used to scrape the cleaner along the pane, typically, to a bottom portion of the perimeter of the window. In a third step, the squeegee as well as the bottom portion of the window are wiped clean, typically, with a rag or sponge.

Most spray bottle dispensers are very similar. The typical spray bottle dispenser consists of a bottle portion and a spray head portion. The bottle portion has an externally threaded neck portion to which the spray head portion connects by an internally threaded collar. The spray head portion further includes a nozzle portion as well as a housing portion out of which extends a trigger portion for operating a pump inside the housing portion. A dip tube connected to an inlet of the pump extends from the housing portion through the collar portion and into the bottle portion. When the spray head portion is connected to the bottle portion, at least a portion of the dip tube is immersed in product contained in the bottle portion.

The bottle portion is typically grasped and operated with one hand such that at least one finger, typically, the index finger and perhaps the middle finger, extend to the trigger portion. In operation, the dispenser, and specifically, the nozzle portion of the spray head portion, is held proximally to a surface to which the product in the bottle portion is to be applied. The trigger is then pulled causing product to be pumped through the dip tube into the pump and to the nozzle, out of which the product is sprayed, typically, in a substantially conical spray configuration. Typically, the conical spray configuration produces a circular spray pattern on a surface to which the product is applied provided that the nozzle is held within a predetermined range from the surface during operation.

When the surface onto which the product is to be applied is larger than the largest available spray pattern produced by the dispenser, the entire dispenser must be moved and operated at different locations relative to the surface so as to apply product to the entire surface. While these locations may be chosen arbitrarily, the consumer, ever concerned with saving valuable time and effort, is likely to move the dispenser in an efficient manner such that product is applied from locations which define generally longitudinal and/or transverse paths about any given surface. This type of operation of a spray bottle dispenser is referred to as the natural operation of a spray bottle dispenser.

In naturally operating a spray bottle dispenser, a consumer may move the spray bottle dispenser to perhaps 10 to 100 discrete locations relative to, for example, the surfaces of a wash area such as a shower stall or a particularly large pane of glass, to adequately apply product thereto.

It is a first object of the present invention to take advantage of the natural operation of a spray bottle dispenser.

It is a second object of the present invention to provide a dispensing apparatus which allows the dispensing of a product to be combined simultaneously with another function.

It is a third object of the present invention to provide surface contacting with a spray bottle dispenser.

It is a fourth object of the present invention to provide a dispensing apparatus.

It is a fifth object of the present invention to provide an improved dispensing apparatus.

It is a sixth object of the present invention to provide a surface contacting portion for a dispensing apparatus.

It is a seventh object of the present invention to provide an improved surface contacting portion for a dispensing apparatus.

It is an eighth object of the present invention to increase the efficiency of coverage of a spray from a dispensing apparatus.

It is a ninth object of the present invention to provide a dispensing apparatus which increases the efficiency of products dispensed from spray bottles.

It is a tenth object of the present invention to provide an apparatus which increases the effectiveness of products dispensed from spray bottle dispensers.

It is an eleventh object of the present invention to provide an apparatus which increases the ease with which products are dispensed from spray bottle dispensers.

It is a twelfth object of the present invention to provide a dispensing apparatus including a spray bottle dispenser including a bottle portion and a spray head portion and a frame portion connecting the dispenser to a surface contacting portion and configured such that when the dispensing apparatus is in an upright position, the surface contacting portion is located above and in front of a nozzle portion of the spray head portion.

It is a thirteenth object of the present invention to provide an apparatus including a surface contacting portion connected to a frame portion, the frame portion connected to a dispenser having a bottle portion and a spray head portion such that when the dispenser is substantially upright and a product is dispensed to a substantially vertical surface from a nozzle exit of the spray head portion only translation of the dispenser in a direction consisting of a downward vertical component is necessary for simultaneously contacting the product and the surface with the surface contacting portion It is a fourteenth object of the present invention to provide a method of applying a product to a vertical surface including the steps of holding a dispenser having a bottle portion and a spray head portion in a substantially upright orientation proximally to a vertical surface such that a surface contacting portion attached to the dispenser is in contact with the vertical surface and dispensing a product onto the vertical surface with the dispenser, and translating the dispenser in a direction consisting of a downward vertical component to apply at least a portion of the product to the surface.

The present invention is directed to surface contacting with a spray bottle dispenser. In a preferred embodiment the present invention includes a spray bottle dispenser including a bottle portion and a spray head portion and a frame portion connecting the dispenser to a surface contacting portion and configured such that when the dispensing apparatus is in an upright position, the surface contacting portion is located above and in front of a nozzle portion of the spray head portion.

When the dispensing apparatus of the present invention is used to apply a product to a surface, the surface contacting portion is preferably simultaneously in contact with the surface. Thus, the present invention is particularly appropriate for use in situations calling for the natural operation of a spray bottle dispenser. For example, the present invention is particularly appropriate for use with cleaners which are sprayed onto surfaces proximal to a personal wash area, for example, a shower or bath, immediately or relatively soon after the wash area is used.

In a preferred embodiment of the present invention the surface contacting portion is provided with a wiper portion. Accordingly, when a dispensing apparatus including a spray bottle dispenser and a surface contacting portion according to the present invention is used to apply the above discussed preventive maintenance type cleaning product to the surface of a wash area according to the natural operation of a spray bottle dispenser, the surface contacting portion, and particularly the wiper portion perform a number of functions.

First, the wiper portion serves to spread the dispensed droplets of product over the surface uniformly as it follows behind the nozzle portion in the natural operation of the dispenser, thereby providing an improved application of product. More specifically, the wiper portion displaces the droplets which make up the spray pattern and spreads each droplet over the surface to which the product has been applied. Use of the invention thereby promotes less usage of product since product is applied more efficiently. Second, the wiper portion also scrapes some of the dirt which the product is intended to clean. This provides enhanced cleaning of the surface and allows for even greater periods of time between episodes of thorough cleaning of the wash area. Third, the surface contacting portion provides a gauge for applying product to the surface. More specifically, during natural operation of a dispensing apparatus according to the present invention, the surface contacting portion serves to set the nozzle portion of the dispensing apparatus a predetermined distance away from the surface to which product is being applied, thereby further ensuring uniform application of product to the surface.

Another example of a benefit achieved by use of the present invention is realized when a dispensing apparatus according to the present invention is used to apply glass cleaner in a typical window cleaning operation. A dispensing apparatus according to the present invention configured to apply glass cleaner preferably includes a surface contacting portion defining a wiper portion. In a first step, window cleaner is applied to the window surface according to the natural operation of a spray bottle dispenser. In a conventional second step, the consumer would place a squeegee against the window surface and drag the same across the glass surface so as to scrape the cleaner typically to a bottom segment of the perimeter of the window. With the wiper portion of the present invention, window cleaner is scraped to a bottom segment of the perimeter of the window simultaneously with the application of product to the window. Thus, the first and second step are merged into a single step resulting in a significant savings of time and effort. The remaining step i.e. the cleaning of any residue from the bottom of the window and the wiping of the blade portion of the surface contacting portion is carried out in the usual way.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a front view of a directional indication.

FIG. 10 is a front view of a directional indication.

FIG. 11 is a front view of a wall with a circular spray pattern produced thereon by a dispensing apparatus according to the present invention.

FIG. 12 is a partial side view of a surface contacting portion of a dispensing apparatus according to the present invention.

FIG. 13 is a front view of a wall with a pair of circular spray patterns produced thereon by a dispensing apparatus according to the present invention.

FIG. 14 is a front view of a wall with a set of circular spray patterns and a directional line indicating use of a dispensing apparatus including a surface contacting portion according to the present invention.

FIG. 15 is a partial side view of a surface contacting portion and a spray head portion of a dispensing apparatus according to the present invention.

FIG. 16 is a side view of a surface contacting portion of a dispensing apparatus according to the present invention.

FIG. 17 is a partial cross sectional view taken along the line 17—17 shown in FIG. 16.

FIG. 22 is a partial top view of the spray bottle dispenser shown in FIG. 3.

FIG. 23 is a partial cross-sectional view of the apparatus along the line 21—21 shown in FIG. 3.

FIG. 24 is a partial cross-sectional top view of an alternative embodiment of a frame according to the present invention.

FIG. 25 is a partial view of an apparatus according to the present invention in schematic form.

FIG. 29 is a partial side view of a dispensing apparatus including a surface contacting portion and a spray head portion according to the present invention.

FIG. 30 is a partial cross-sectional side view of a wiper portion and an extending portion of a frame of a surface contacting portion according to the present invention.

FIG. 31 is a front view of the leading edge of the wiper portion shown in FIG. 21 according to the present invention.

FIG. 32 is a partial side view of a dispensing apparatus including a surface contacting portion and a spray head portion according to the present invention.

FIG. 33 is a front view of the leading edge of the wiper portion shown in FIG. 23 according to the present invention.

FIG. 34 is a front view of the leading edge of a wiper portion according to the present invention.

FIG. 35 is a front view of the leading edge of a wiper portion according to the present invention.

DETAILED DESCRIPTION OF PREFERRED EMBODIMENTS

Figure 1:
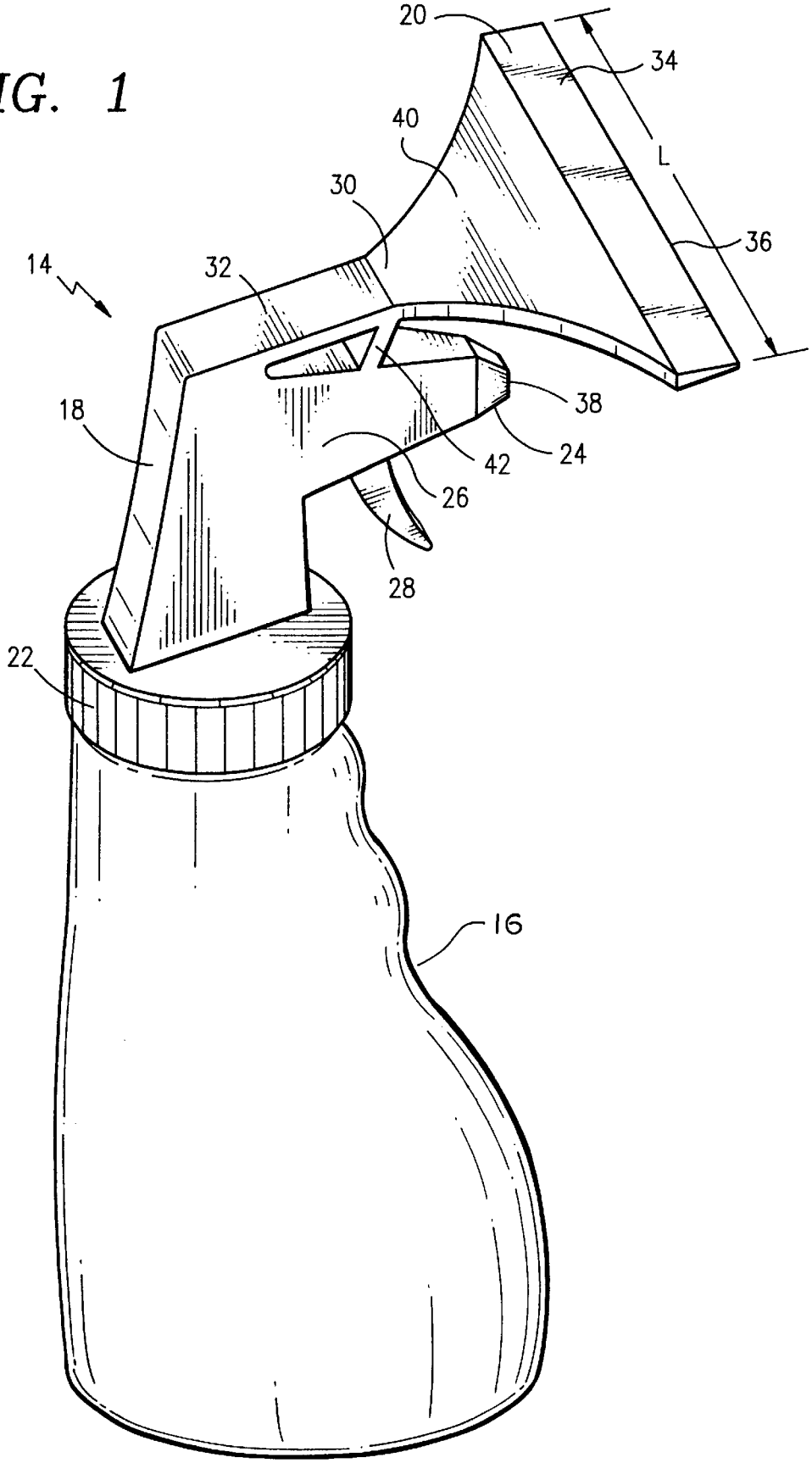
FIG. 1 is a perspective view of a preferred embodiment of a dispensing apparatus according to the present invention.
Figure 2:
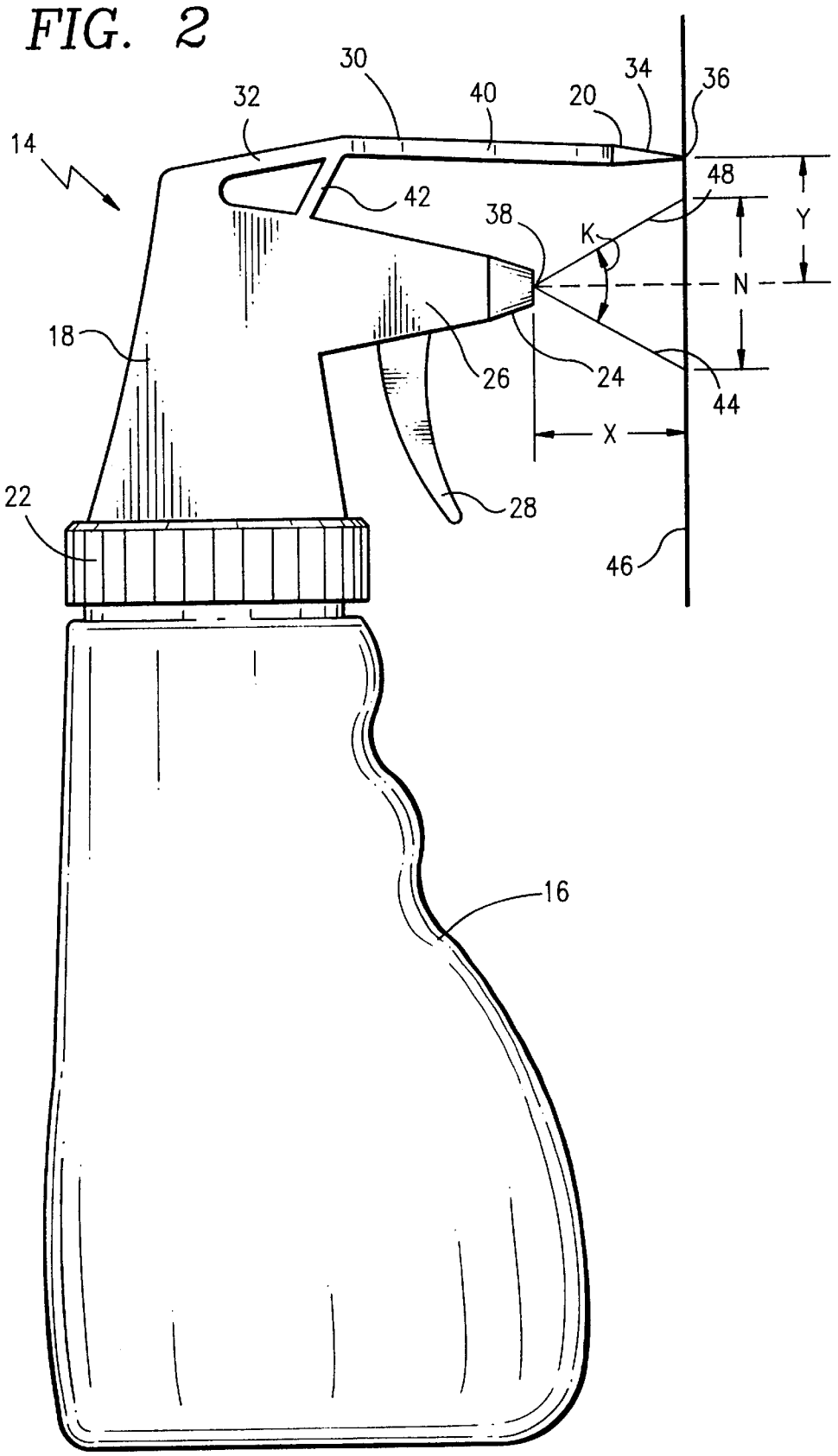
FIG. 2 is a side view of a preferred embodiment of a dispensing apparatus according to the present invention.
Figure 3:
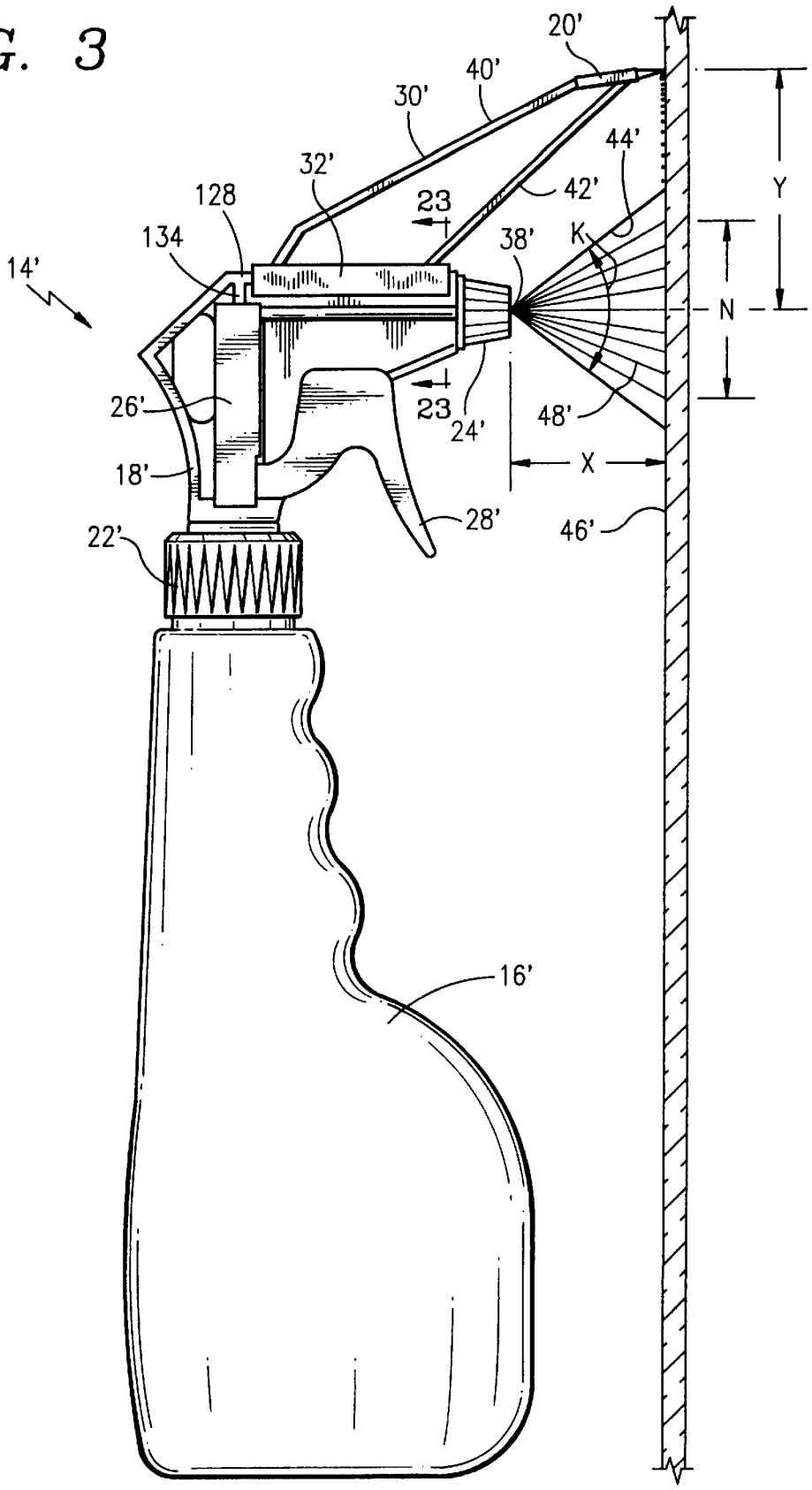
FIG. 3 is a side view of a preferred embodiment of a dispensing apparatus according to the present invention.

FIGS. 1 and 2 show a preferred embodiment of a dispensing apparatus 14 according to the present invention. Another preferred embodiment of an apparatus 14' according to the present invention is shown in FIG. 3 wherein part numbers used to indicate parts similar to those shown in FIGS. 1 and 2 include a prime symbol (') directly adjacent thereto, thus, 14 is 14'.

Apparatus 14 includes a spray bottle dispenser having a bottle portion 16 with an externally threaded neck portion (not shown) and a spray head portion 18 to which is connected an independently rotatable internally threaded collar portion 22 for connecting spray head portion 18 to bottle portion 16. Spray head portion 18 further includes a nozzle portion 24 including a nozzle exit 38 and a housing portion 26 out of which extends a trigger portion 28 for operating a pump (not shown) therein. A dip tube (not shown) which feeds the pump extends from housing portion 26 through collar portion 22 into bottle portion 16. When spray head portion 18 is connected to bottle portion 16, preferably, at least a portion of the dip tube (not shown) is immersed in a product contained in bottle portion 16.

Apparatus 14 also includes a surface contacting portion 20. Surface contacting portion 20 connects to spray head portion 18 by a frame portion 30. Frame portion 30 includes a base portion 32, an extending portion 40 and a support portion 42.

Figure 4:
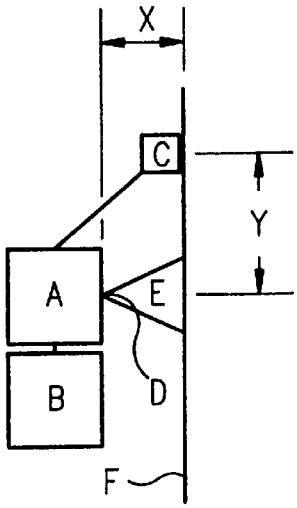
FIG. 4 is a side view of a preferred embodiment of a dispensing apparatus according to the present invention in schematic form.
Figure 5:
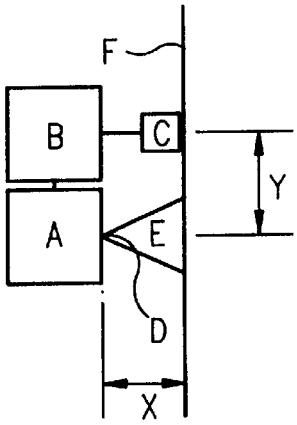
FIG. 5 is a side view of a preferred embodiment of a dispensing apparatus according to the present invention in schematic form.
Figure 6:
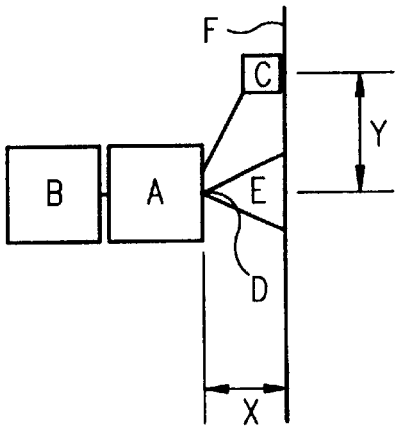
FIG. 6 is a side view of a preferred embodiment of a dispensing apparatus according to the present invention in schematic form.

Apparatus 14 is shown in a substantially vertical upright position in FIGS. 1 and 52. Surface contacting portion 20 is positioned above nozzle exit 38 by a distance, Y, and in front of nozzle exit 38 by a distance, X. FIGS. 4–6 show further embodiments of a spray bottle dispensing apparatus according to the present invention. Each of the embodiments in FIGS. 4–6 is shown in a substantially vertical upright position. In each of the embodiments shown in FIGS. 4–6 the bottle portion of the dispensing apparatus is represented by the letter B, the spray head portion by the letter A, the nozzle portion by the letter D, and the surface contacting portion by the letter C. Each dispensing apparatus represented in FIGS. 4–6 is shown applying a conical spray represented by the letter E onto a vertical surface represented by the letter F. Note that for each embodiment shown, surface contacting portion C is positioned above nozzle portion D by a distance Y, and in front of nozzle portion D by a distance X.

Figure 7:
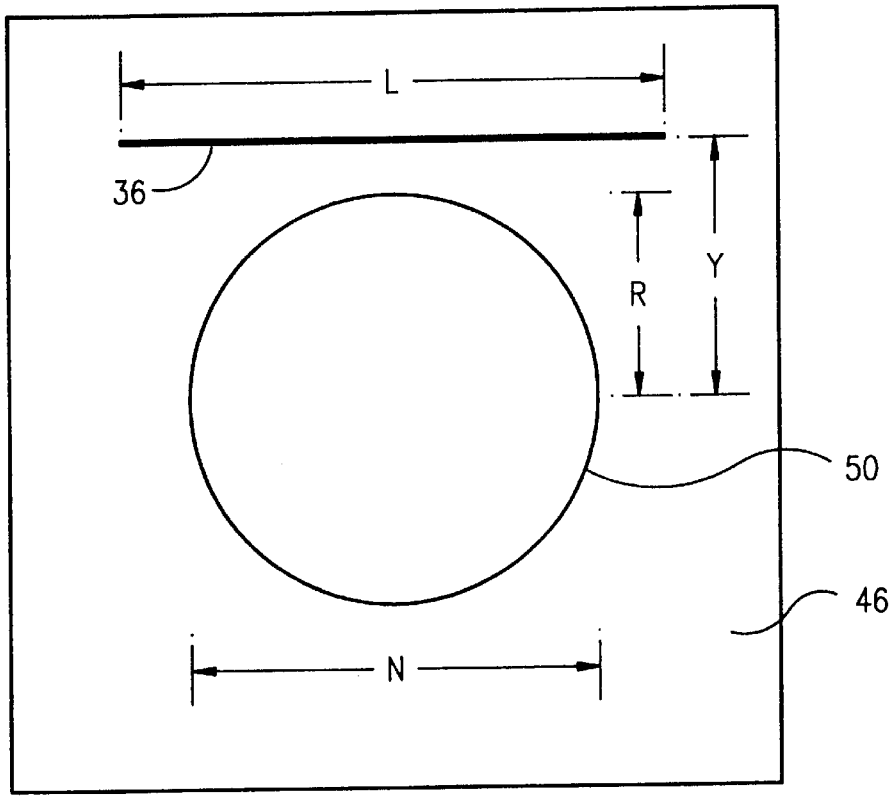
FIG. 7 is a front view of a wall with a circular spray pattern produced thereon by a dispensing apparatus according to the present invention in schematic form.

Referring back to FIGS. 2 and 3, a preferred embodiment of a dispensing apparatus 14 is shown with surface contacting portion 20 defining a wiper portion 34 having a leading edge 36 in contact with a vertical surface 46. When trigger 28 is pulled, a product 48 is pumped from bottle portion 16 through spray head portion 18 and nozzle exit 38. In the embodiments shown in FIGS. 2 and 3, product 48 is dispensed in the form of a substantially conical spray 44 having a cone angle, K. The diameter of conical spray 48 increases until impacting vertical surface 46 to form a substantially circular spray pattern 50 as shown in FIG. 7.

As shown in FIGS. 2 and 3, surface contacting portion 20 is positioned in front of nozzle portion 24 by a dimension, X, which is defined as the distance between a vertical line passing through nozzle exit 38 and a vertical line passing through leading edge 36. Note that dimension, X, is directly proportional to the diameter, N, of circular spray pattern 50.

As shown in FIG. 6, it is preferable according to the present invention for the length, L, of edge 36 to be at least as large as the diameter, N, of circular spray pattern 50. This may be accomplished through a configuration of cone angle, K, length, L, and/or dimension, X, any or all of which may be configured to be adjustable according to the present invention.

Surface contacting portion 20 may be configured, as shown in FIGS. 2 and 3, to define a gauge for determining when said nozzle portion is located at a proper distance from a surface for dispensing a product to the surface.

Further, as shown in FIGS. 2 and 3, surface contacting portion 20 is positioned above nozzle portion 24 by a dimension, Y, which is defined as the distance between a horizontal line passing through nozzle exit 38 and a horizontal line passing through leading edge 36. As shown in FIG. 6, it is preferable, according to the present invention for the radius, R, shown in FIG. 6, of circular spray pattern 50 to be less than the dimension, Y. This prevents interference between conical spray 44 and surface contacting portion 20. In other words, it is preferable for leading edge 36 to be located outside circular spray pattern 50, as shown in FIGS. 2 and 6.

In operation, the dispenser apparatus shown in FIGS. 1–3 is typically grasped in one hand such that the trigger 28 may be operated with one or two fingers, typically, the index and/or middle fingers. According to the present invention, a method of applying a product, such as a preventive maintenance type washroom surface cleaner, to a surface involves holding the preferred embodiment of a spray bottle dispensing apparatus 14 shown in FIGS. 1–3 in one hand in the manner just described. Apparatus 14 is then positioned proximally to, for example, a vertical surface 46 to which the product is to be applied such that the edge 36 of surface contacting portion is in contact with the surface 46 as shown in FIGS. 2 and 3. The trigger 28 is then pulled and a conical spray 44 is dispensed from the nozzle exit 38. A circular spray pattern 50 is formed on surface 46 as shown in FIG. 7.

Figure 8:
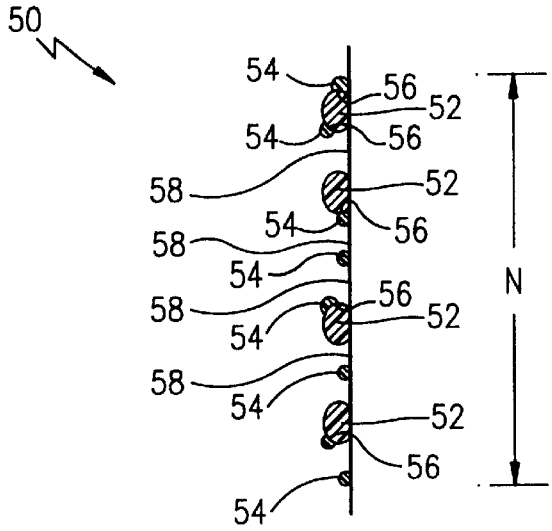
FIG. 8 is a side view of a wall with a spray pattern produced thereon by a dispensing apparatus according to the present invention.

A detailed cross-sectional side view of circular spray pattern 50 is shown in FIG. 8. Note that there are water droplets 52 on vertical surface 46 shown in FIG. 8. Such droplets 52 are typically present on the typical washroom surface immediately after the washroom is used. Also shown in FIG. 8 are droplets of preventive maintenance type cleaner 54 which form circular spray pattern 52.

A further step involved in this particular method of the present invention involves translating apparatus 14 in a direction having at least a downward vertical component, V, and optionally, a horizontal component, H, to produce a resultant direction, D, as shown by example in schematic form in FIGS. 9 and 10. Note from FIG. 9 that there is no horizontal component, H, thus, the resultant direction, D, is purely downward and vertical. FIG. 10 shows a resultant direction, D, having a downward vertical component, V, as well as a horizontal component, H.

As apparatus 14 is translated in the above-described manner, edge 36 of wiper 34 enters circular spray pattern 50 as shown in schematic form in FIG. 11. Wiper portion 34, and specifically edge 36 thereof, move along vertical surface 46 and break apart, mix, and wipe away excess droplets of water 56 and cleaner 54 as shown in FIG. 12. Preferably, a residual layer 60 of water and cleaner is left behind as is further shown in FIG. 12. Residual layer 60 is shown in schematic form in FIG. 12. The dashed line 50' in FIG. 13 indicates circular spray pattern 50 prior to contact with surface contacting portion 20. Note that the area defined by the edges of residual layer 60 includes the area defined by dashed line 50'. Thus, use of the present invention provides a substantial increase in the area of application of a product. As apparatus 14 is translated according to the above-described method the nozzle exit 38 is thereby automatically placed in position for the next application cleaner to surface 46, as shown in FIG. 13.

FIG. 14 shows an exemplary portion 47 of a vertical surface, about which apparatus 14 is translated to locations 62 which define generally longitudinal paths 64. It should be noted that the movement of apparatus 14 required to practice the above described method according to the present invention closely parallels the movement associated with the natural operation of a spray bottle dispenser.

The surface contacting portion 20 shown in FIGS. 1 and 2 is integral to apparatus 14. However, it is important to note that surface contacting portion 20 may be configured to attach, in a permanent to semi-permanent to non-permanent configuration, to any site on apparatus 14. For example, as shown in FIG. 15, a surface contacting portion 201 according to the present invention may be provided as an "after-market" type product for a permanent type of attachment with double sided tape 66 for mounting base portion 321 to spray head portion 181 of a spray bottle dispenser. Alternatively, base portion 322 of a surface contacting portion 202 may be configured for semi-permanent attachment as shown in FIGS. 16 and 17. Base portion 322 is provided with a pair of opposed projections 68 each including retaining means in the form of barbs 70 for a "snap on" type attachment to a pair of opposed slots 72 in spray head portion 182.

Figure 18:
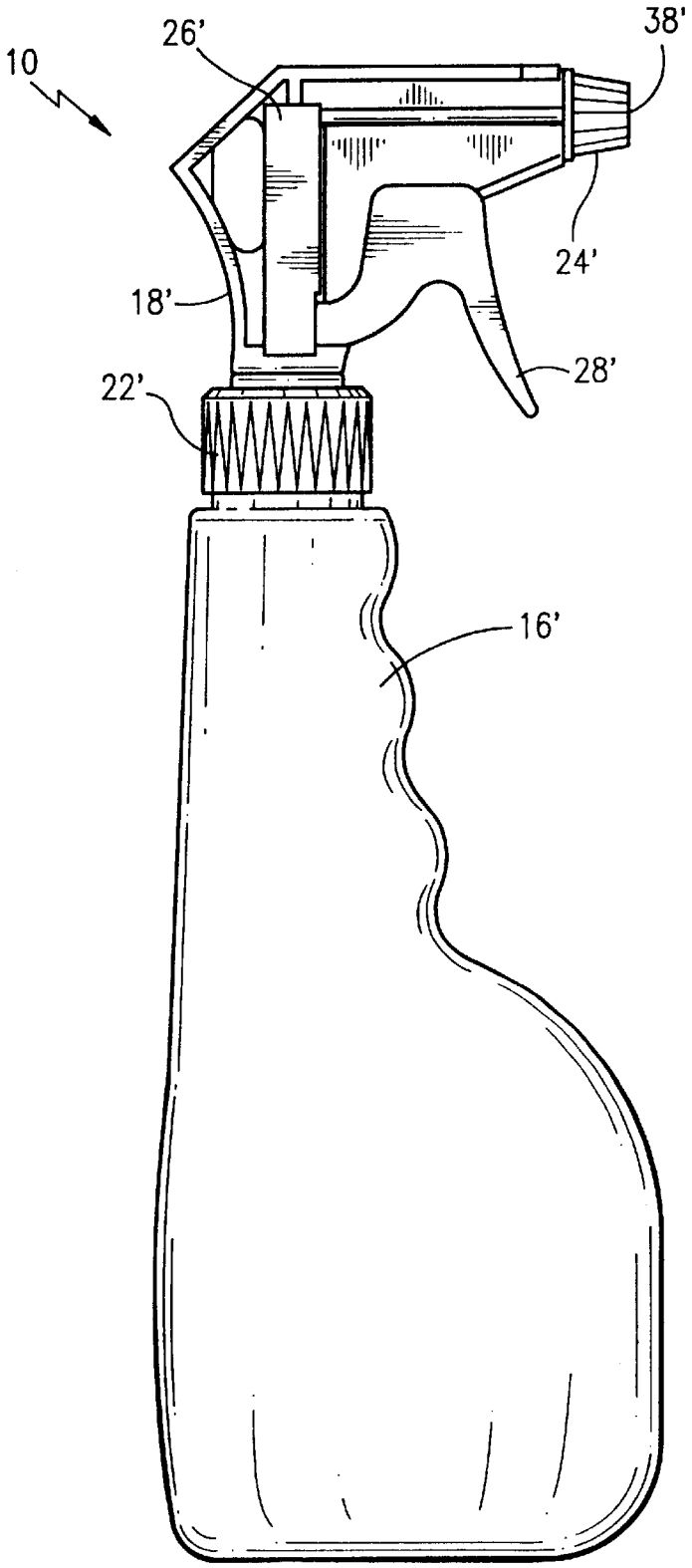
FIG. 18 is a side view of a spray bottle dispenser.
Figure 19:
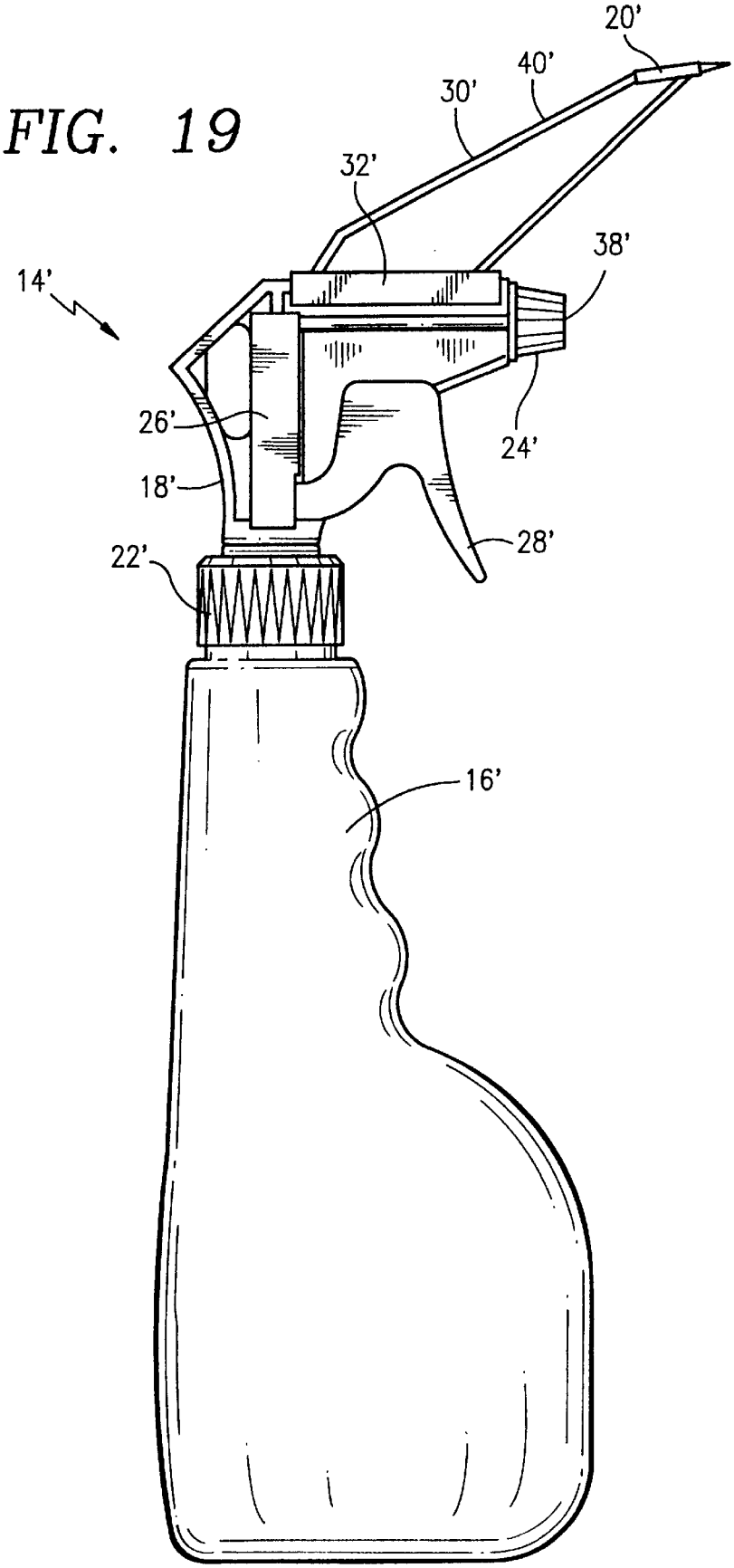
FIG. 19 is a side view of a preferred embodiment of a dispensing apparatus according to the present invention.

The embodiment of surface contacting portion 20' shown in FIG. 3 is also configured for non-permanent attachment. Spray bottle dispenser 10 is shown in FIG. 18 without a surface contacting portion according to the present invention. Dispensing apparatus 14' including surface contacting portion 20' is shown in FIG. 19. The details of removably attachable surface contacting portion 20' will now be described.

Figure 20:
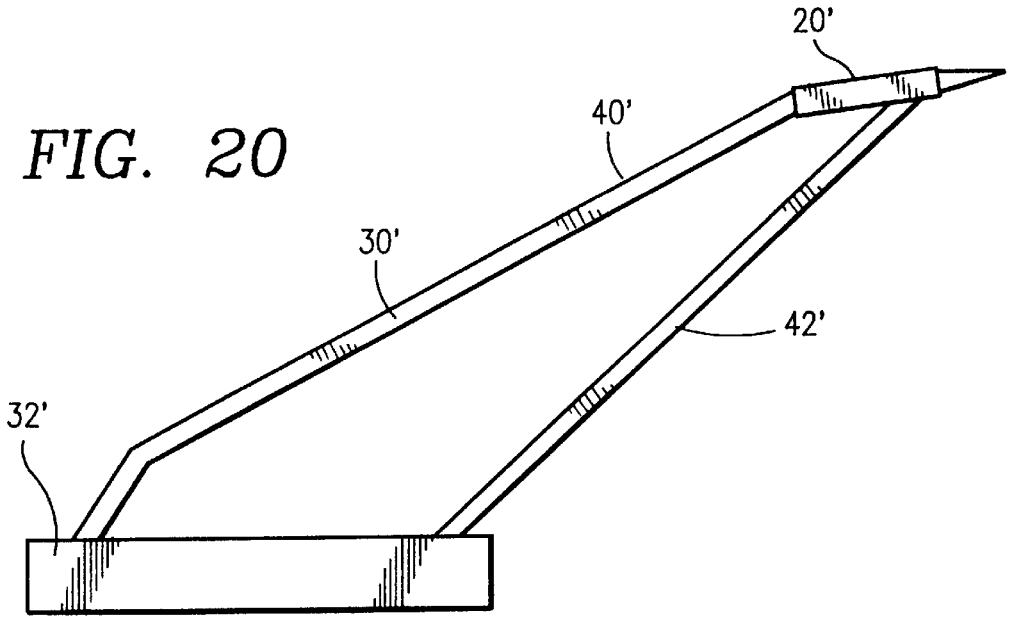
FIG. 20 is a side view of a preferred embodiment of a frame portion connected to a surface contacting portion according to the present invention.
Figure 21:
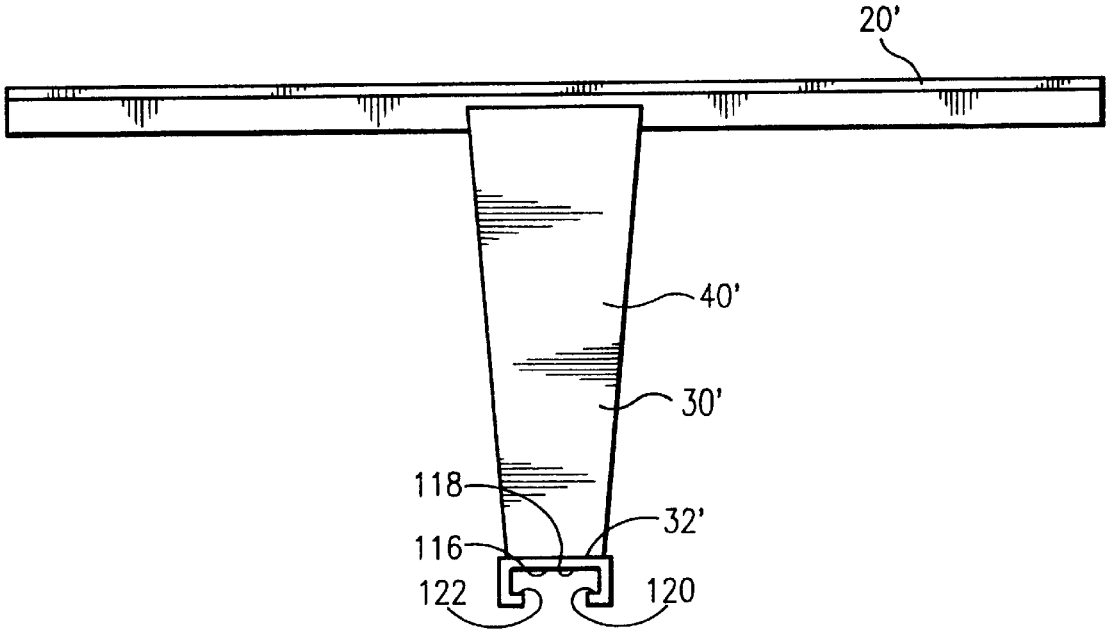
FIG. 21 is a planar view of the preferred embodiment shown in FIG. 18.

As shown in FIGS. 20–21, the base portion 32' of frame 30' includes a channel 116 having an upper surface 118, side surfaces 120 and lower surfaces 122. As shown in FIGS. 3, 18 and 22, spray head portion 18' includes a main beam portion 128 having parallel edges 130 and tapering edges 132. Surface contacting portion 20', or more specifically, frame portion 32', shown in FIG. 23, is removably attached to main portion 128 by sliding frame portion 32' over tapering edges 132 and parallel edges 130 of main beam portion 128 as shown in FIGS. 3, 19 and 23. Note that spray head portion includes a vertical beam portion 134 which the rear edge 136' of frame portion 32' contacts to indicate that attachment is complete. Vertical beam portion 134 provides a surface to prevent further advancement of frame portion 32' along main beam 128 during use of apparatus 14'.

The upper surface 118 and lower surfaces 122 of channel 116 are preferably in frictional contact with the top surface 124 and bottom surfaces 126 of the main beam portion 128 of spray head portion 18', as shown in FIG. 22, thereby preventing frame 32' from translating up or down relative to main beam portion 128 and preventing frame 32' from pivoting about a horizontal axis relative to main beam portion 128. The side surfaces 120 of channel 116 are preferably in frictional contact with the edges 130 of main beam portion 128 thereby preventing frame 32' from translating side to side relative to main beam portion 128 and preventing frame 32' from pivoting about a vertical axis relative to main beam portion 128.

An alternative embodiment of a removably attachable base portion 321' is shown in FIG. 24. As shown in schematic form in FIG. 25, base portion 321' is configured to allow surface contacting portion to slightly rotate to track an off-plane surface 461' without the need for realignment of main beam portion 128 with such a surface. Base portion 321' includes a channel 1161' having tapering side walls 1201' and tapering lower surfaces 1221'. Thus, channel 1161' allows frame 321' to rotate in a limited range about a vertical axis relative to main beam portion 128, indicated by directional arrow P, shown in FIG. 24.

Figure 26:
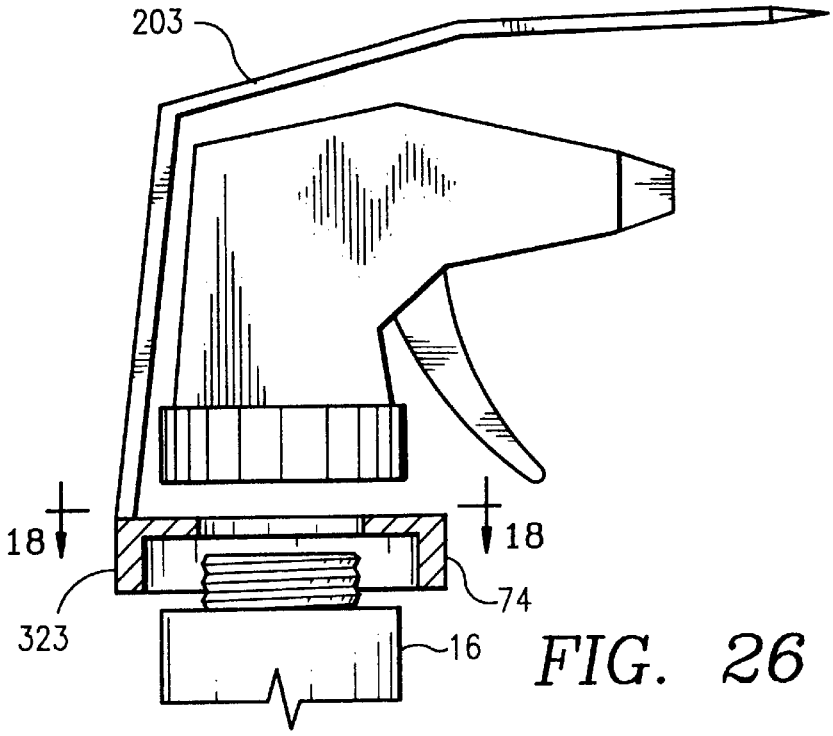
FIG. 26 is an exploded partial side view of a surface contacting portion, a spray head portion, a frame, and a bottle portion of a dispensing apparatus according to the present invention.
Figure 27:
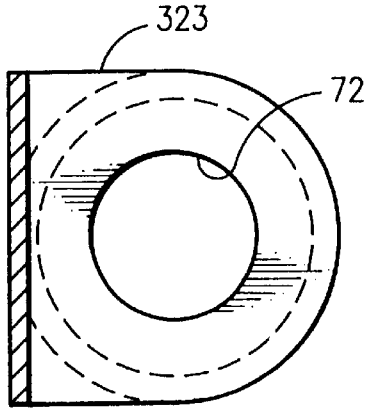
FIG. 27 is a partial cross-sectional view of the frame shown in FIG. 17.
Figure 28:
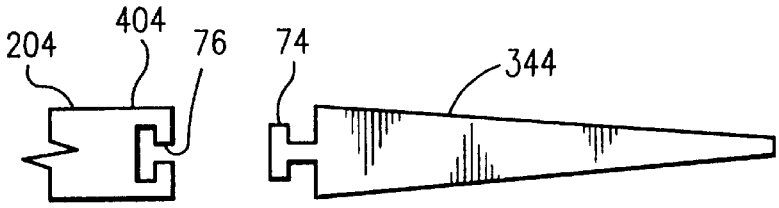
FIG. 28 is a partial side view of a dispensing apparatus including a surface contacting portion and an extending portion according to the present invention.

Another alternative embodiment of a base portion 323 which is configured for non-permanent or removable attachment to apparatus 14, is shown in FIGS. 26 and 27. Base portion 323 is provided with an orifice 72 for interposing base portion 323 between the collar portion 222 of spray head portion 182 and bottle portion 162 of apparatus 14, as shown in FIG. 26. Base portion 323 also includes an integral skirt 74 which slides over the outer surface of bottle portion 16 to provide additional support for surface contacting portion 203 as shown in FIG. 28.

The wiper portion 34 shown in FIGS. 1–3 is integral to extending portion 40 of frame portion 30. Wiper portion 34 may be configured as a separate component which is attached to extending portion 40 either during the manufacture of apparatus 14. Alternatively, components of the present invention may be provided to the consumer for assembly. For example, as shown in the exploded partial side view of FIG. 28, a surface contacting portion 204 includes a separate wiper portion 343 which includes attachment structure in the form of a winged tab 76 which cooperates with corresponding attachment structure in the form of a winged channel 78 in extending portion 404. Assembly is accomplished by sliding tab 76 through channel 78. Winged tab 76 may be slightly oversized to create an interference between tab 76 and channel 78 thereby fixing wiper portion 344 relative to extending portion 404. Alternatively, an adhesive may be used between tab 76 and channel 78 to fixate wiper portion 343 relative to extending portion 343. Note that embodiments of a surface contacting portion according to the present invention which include separate components facilitate the use of different materials in the construction thereof. For example, wiper portion 344 may be preferably made of rubber whereas extending portion 404 may be preferably made of plastic. A surface contacting portion which is removably attachable to frame 404 facilitates the use of interchangeable embodiments of a surface contacting portion according to the present invention.

Surface contacting portion 20 shown in FIGS. 1–3 is substantially fixed relative to nozzle portion 24. However, surface contacting portion 20 may be configured to move in any possible direction relative to nozzle portion 24 according to the present invention. For example, a partial view of a dispensing apparatus 145 according to the present invention is shown in FIG. 29. Apparatus 145 includes an extending portion 405 having a reduced thickness 80 to allow for flexion of frame 305 and thus, relative movement between nozzle portion 245 and surface contacting portion 205. Alternatively or in addition to reduced wall thickness 80 in extending portion 405, base portion 325 may include an area of reduced wall thickness 845. Reduced wall thickness 845 allows for pivoting of frame portion 305 relative to spray head portion 185. Preferably, apparatus 185 is configured such that frame 305 is biased to return to its configuration prior to pivoting.

A cross-sectional view of wiper portion 34 is shown in FIG. 30. Wiper portion 34 includes a planar upper surface 84 and a planar lower surface 86. As shown in FIGS. 30 and 31, wiper portion tapers transversely to a leading edge 36, however, wiper portion may be configured to taper to a leading edge 36 which defines a face 88 as shown in FIGS. 32 and 23. Note that face 88 may include a surface texture, such as ridges (not shown), dimples (not shown), or bumps (not shown). Further, leading edge 36 is shown in FIGS. 31 and 33 as having a straight longitudinal centerline. However, leading edge 36 may define any centerline, for example, leading edge 36 may define a curvilinear centerline as shown in FIG. 34 or a centerline having angled ends 90 as shown in FIG. 35.

Figure 36:
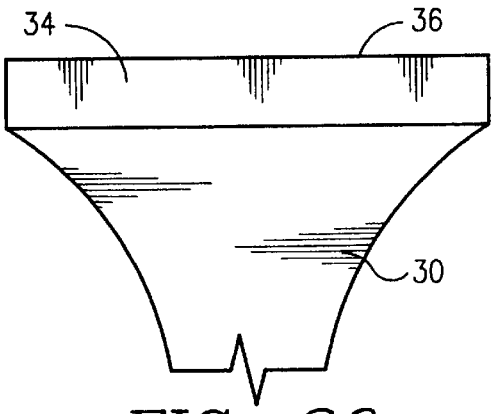
FIG. 36 is a top view of a surface contacting portion according to the present invention.
Figure 37:
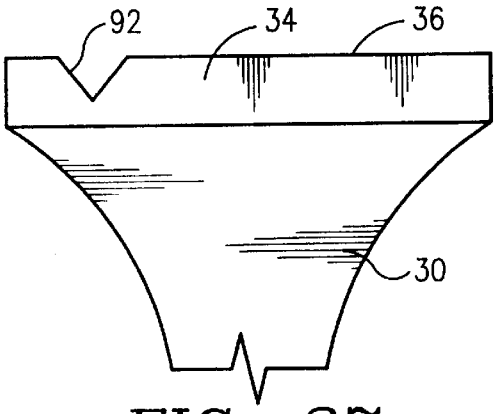
FIG. 37 is a top view of a surface contacting portion according to the present invention.
Figure 38:
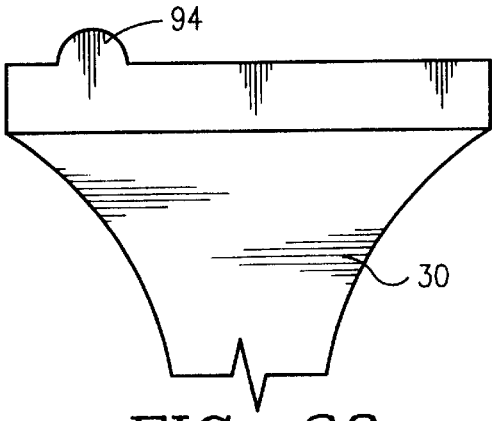
FIG. 38 is a top view of a surface contacting portion according to the present invention.

A top view of wiper portion 34 is shown in FIG. 36. Note that wiper portion 34 and particularly, leading edge 36, are configured for contacting a planar surface. Wiper portion 34 may be configured for contacting other types of surfaces, for example, a portion of edge 36 may include a triangular shaped recess 92 for contacting a comer type surface as shown in FIG. 37. Alternatively, edge 36 may include a protruding portion 94, as shown in FIG. 38, for contacting, for example, grout surfaces between rows of bathroom tiles.

Figure 39:
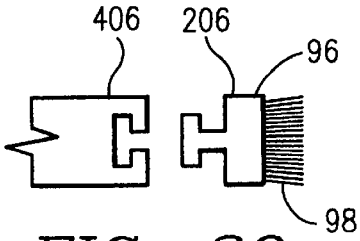
FIG. 39 is a side view of a surface contacting portion in the form of a scrub brush.
Figure 40:
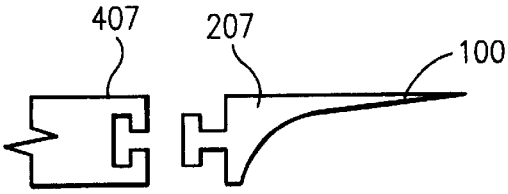
FIG. 40 is a side view of a surface contacting portion in the form of an overspray limiter.
Figure 41:
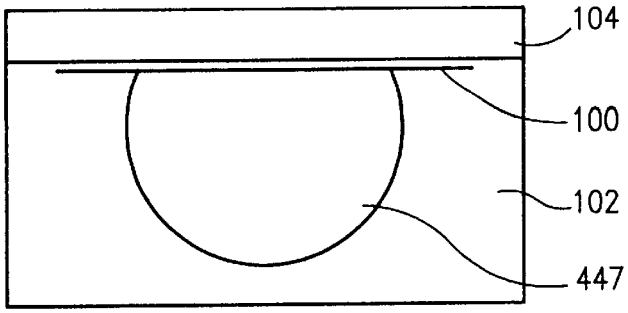
FIG. 41 is a front view of a wall with a spray pattern produced thereon by a dispensing apparatus according to the present invention.

An alternative embodiment of a surface contacting portion 206 is shown in FIG. 39. Surface contacting portion 206 defines scrub brush portion 96 having bristles 98. A further alternative embodiment of a surface contacting portion 207 is shown in FIG. 40. Surface contacting portion 207 defines a spray limiter portion. In certain situations, such as in the application of certain types of chemicals, for example, paints or polishes, it is desirous to prevent overspray. Thus, as is shown in FIG. 41, a surface contacting portion 207 in the form of a spray limiter 100 according to the present invention may be used to maintain conical spray 447 within area 102 and thus prevent overspray into area 104.

Figure 42:
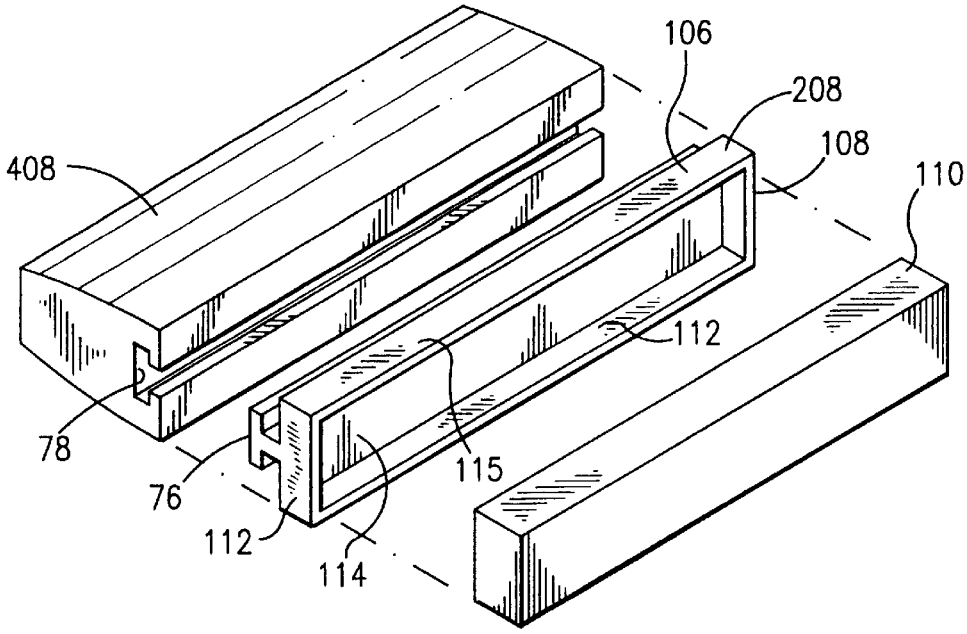
FIG. 42 is a perspective view of a surface contacting portion in the form of an applicator portion according to the present invention.

Another alternative embodiment of a surface contacting portion 208 according to the present invention is shown in FIG. 42. Surface contacting portion 208 defines an applicator portion 106 including a sub-frame portion 108 and an applicator material portion 110 which is mounted in sub-frame portion 108. Sub-frame portion 108 is removably attachable to extending portion 408 of frame 306 by way of channel 78 in extending portion 406 and tab 76 on holder portion 96. Sub-frame portion 108 includes walls 112 and floor 114 which are configured to receive and to support applicator material portion 98. Preferably, applicator material portion 98 is held in place by a moisture resistant adhesive (not shown) or other suitable adhesive. Alternatively, applicator material portion 110 may be integral to sub-frame portion 108 and mounted directly to extending portion 406 (not shown). Applicator portion 208 is preferably configured to apply a product dispensed from a nozzle portion of a dispensing apparatus 14 according to the present invention.

Material portion 110 is preferably made of a sponge-like material. In other words, material portion 110 is preferably configured to absorb liquid material in a non-compressed state and to release absorbed liquid material when compressed. Alternatively, material portion 110 can be made of a foam-like, non-absorbent material. As another example, material 110 can be made of a substance which dissolves in the presence of a chemical such as water.

Material portion 110 may be provided with an interspersed particulate chemically inert material for scouring purposes during application of a product to a surface, or as another example, material portion 110 may be provided with a scouring pad such as a "3M" brand scouring pad adhered to the leading edge thereof.

Further, material 110 may be provided in a pre-saturated condition and loaded into sub-frame portion 108. For example, applicator material portion 110 may be pre-saturated with a chemically reactive product, such as a cleaner, for example, "409" brand cleaner, or an anti-spotting type product, such as "JET-DRI" brand anti-spotting chemical. Such products may be provided at concentrated levels for dilution with a chemical product, such as water, dispensed from the nozzle portion of a dispensing apparatus according to the present invention.

A dropper or other container of concentrated cleaning chemical may be used to introduce a chemical to applicator material portion 110 through holes (not shown) in top wall 115 of sub-frame 108. For example, applicator material 110 may include a fragrant product which is introduced by way of a dropper through the aforementioned holes (not shown) in top wall 115.

As another example, applicator material 110 may include a first product which is configured to chemically react with a second product which is dispensed from a nozzle portion of the dispensing apparatus to form a third product. Further, the first product may be configured to have a first color and the second product may be configured to have a second color and the third product may be configured to have no color, in other words, to be transparent. Alternatively, the first product may be configured to have no color and the second product may be configured to have no color and the third product may be configured to have color.

In environments where it is desirous to limit the action of a chemical, applicator material 110 may include a first product which is neutralized by a second product dispensed from the nozzle portion of dispensing apparatus 14. For example, applicator material 110 may include a cleaning chemical having a first color which reacts with a chemical dispensed from said nozzle portion to form a chemically inert chemical having no color, thus providing an indicia that no active cleaning chemical is present on the surface contacted by the present invention.

Figure 43:
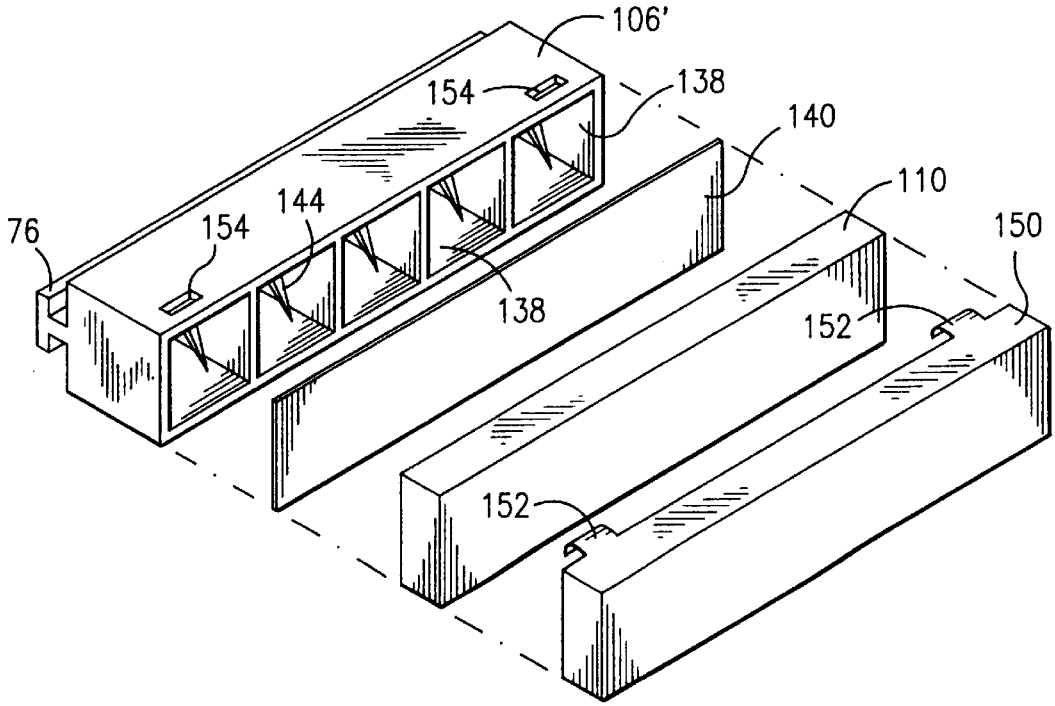
FIG. 43 is a perspective view of a surface contacting portion in the form of an applicator portion including selectively compromised chemical concentrate compartments.
Figure 44:
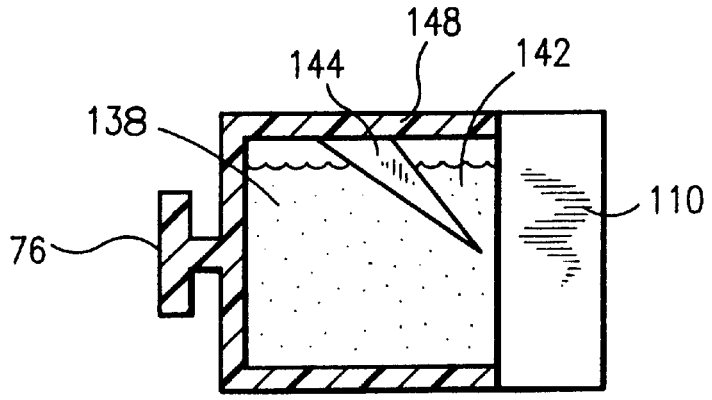
FIG. 44 is a partial cross sectional view of the surface contacting portion shown in FIG. 43.

A further alternative embodiment of an applicator portion 106' according to the present invention is shown in FIG. 43. Applicator portion 106' includes compartments 138. Preferably, and as shown in FIG. 44 each compartment is configured to contain a liquid chemical 142, for example, a concentrated liquid chemical cleaner. As shown in FIG. 43 a cover 140, preferably in the form of a single sheet of foil, is attached to the front of each compartment 138 to seal chemical 142 therein. An applicator material portion 110 is then preferably attached to the front surface of cover 140. Preferably this is accomplished through the use of an adhesive provided along the perimeter of cover 140.

Figure 45:
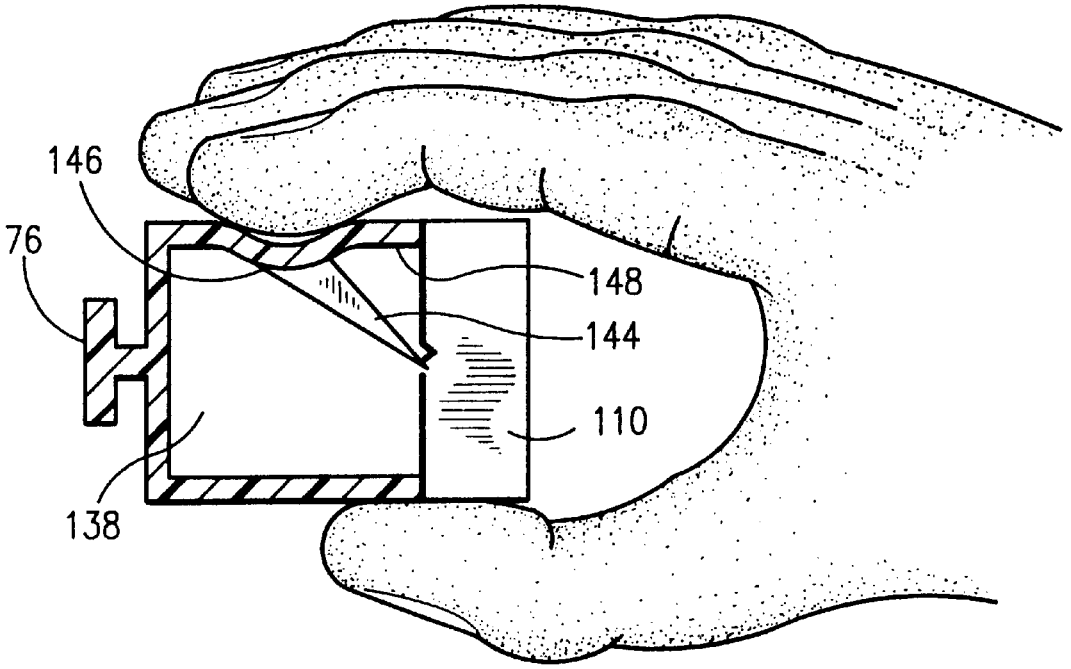
FIG. 45 is a partial cross-sectional view of the surface contacting portion shown in FIG. 43.

Each compartment 138 further includes structure for compromising cover 140 to allow the liquid chemical to escape therefrom into applicator material portion 110 so that the same may be used in a surface contacting operation according to the present invention. As shown in FIGS. 43–45, a sharp tipped piercer 144 is integral to a preferably flexible upper wall 148 of each compartment. As shown in FIG. 45, a user may select a compartment desired to be compromised and squeeze the same thereby causing flexible upper wall 148 to deform slightly and the sharp tip of piercer 144 to break through cover 144. Chemical is thereby released into applicator material portion for use in a surface contacting operation. Note that the adhesive applied to the perimeter of applicator material portion to attach the same to cover 140 prevents the leakage of chemical between cover 140 and applicator material 110, and directs the flow of chemical into applicator material 110. As shown in FIG. 43, a removable cover 150 including barbed tabs 152 which are received in recesses 154 is provided for covering applicator 106' and specifically, material portion 110, when the same is not in use.

It will be apparent from the foregoing that, while particular forms of the invention have been illustrated and described, various modifications can be made without departing from the spirit and scope of the invention. Accordingly, it is not intended that the invention be limited, except as by the appended claims.

What is claimed is:

1. A spray bottle dispensing and cleaning apparatus, said apparatus comprising:

a spray bottle;

a trigger pump spray head connected to said spray bottle, said spray head including a nozzle portion; and a wiper applicator including a wiper blade and wiper blade support connected to said spray head, said wiper applicator being configured so that said wiper blade is located above and in front of said nozzle portion of said spray head to provide simultaneous spraying and wiping by said spray bottle dispensing apparatus.

2. A dispensing apparatus according to claim 1, wherein said said spray head and said wiper applicator are a single unit.

3. A dispensing apparatus according to claim 1, wherein said said spray head and said wiper applicator are separate units.

4. A dispensing apparatus according to claim 3, wherein said spray head includes an upper flange portion, and said wiper blade support is provided with a channel portion configured for accommodating said upper flange portion for connecting said wiper applicator to said spray head.

5. A dispensing apparatus according to claim 1, wherein said upper flange portion includes inwardly tapering edge portions to facilitate assembly of said channel portion of said wiper blade support onto said upper flange portion for connecting said wiper applicator to said spray head.

6. A dispensing apparatus according to claim 1, wherein said wiper applicator is configured so that said wiper blade is oriented substantially parallel with a spray direction of said spray nozzle of said spray head.

7. A dispensing apparatus according to claim 6, wherein said wiper blade support is cantilevered from said spray head and oriented substantially parallel with said spray direction of said spray nozzle of said spray head.

8. A dispensing apparatus according to claim 7, wherein said wiper blade support tapers wider width wise from said spray head to said wiper blade.

9. A dispensing apparatus according to claim 7, wherein said wiper blade support tapers thinner height wise from said spray head to said wiper blade.

10. A dispensing apparatus according to claim 1, wherein said wiper blade support of said wiper applicator includes a base portion, an extending portion and a support portion.

11. A dispensing apparatus according to claim 1, wherein said wiper blade support extends forward and upward at an angle from said spray head.

12. A dispensing apparatus according to claim 11, wherein said applicator portion includes a chemically reactive product.

13. A dispensing apparatus according to claim 1, wherein said wiper blade support and said wiper blade are integral.

14. A dispensing apparatus according to claim 1, wherein said wiper blade includes a separate wiper blade edge portion.

15. A dispensing apparatus according to claim 1, wherein said wiper applicator includes a non-absorbent material.

16. A dispensing apparatus according to claim 1, wherein said wiper applicator is connected between said spray bottle and said spray head.

17. A dispensing apparatus, comprising:

a spray bottle dispenser including a bottle portion and a spray head portion;

a frame portion connecting said dispenser to a surface contacting portion and configured such that when said dispensing apparatus is in an upright position, said surface contacting portion is located above and in front of a nozzle portion of said spray head portion, said surface contacting portion defining an applicator portion having a sub-frame portion and an applicator material portion, said applicator portion including a chemically reactive product.

18. A dispensing apparatus according to claim 17, wherein said applicator portion includes a concentrated chemically reactive product.

19. A dispensing apparatus according to claim 17, wherein said reactive product reacts with water.

20. A dispensing apparatus according to claim 17, wherein said applicator portion includes a first product which chemically reacts with a second product dispensed from said nozzle portion to form a third product.

21. A dispensing apparatus according to claim 20, wherein said first product has a first color and said second product has a second color and said third product has no color.

22. A dispensing apparatus according to claim 20, wherein said first product has no color and said second product has no color and said third product has color.

23. A dispensing apparatus according to claim 17, wherein said applicator portion includes a fragrant product.

24. A dispensing apparatus according to claim 17, wherein said sub-frame portion includes compartments.

25. A wiper applicator device for spray bottle dispenser provided with a trigger pump type spray head including a nozzle portion, said device comprising:

a wiper blade;

a wiper blade support connected to said wiper blade, said wiper blade support being configured so that said wiper applicator device can be connected to said spray head said wiper blade is located above and in front of said nozzle portion of said spray head so that a trigger of said trigger pump spray head can be operated without interference with said wiper applicator to allow simultaneous spraying and wiping by said spray bottle dispensing apparatus.

* * * * *